US009677293B2

(12) United States Patent
Stien et al.

(10) Patent No.: US 9,677,293 B2
(45) Date of Patent: Jun. 13, 2017

(54) POOL COVER LEADING EDGE RAKE

(71) Applicant: MAYTRONICS LTD., Kibutz Yizrael (IL)

(72) Inventors: Shahar Stien, Ramat Ychay (IL); Igor Grubman, Haifa (IL); Shay Witelson, Kibutz Yizrael (IL)

(73) Assignee: MAYTRONICS LTD., Kibbutz Yizrael (IL)

( * ) Notice: Subject to any disclaimer, the term of this patent is extended or adjusted under 35 U.S.C. 154(b) by 149 days.

(21) Appl. No.: 14/459,332

(22) Filed: Aug. 14, 2014

(65) Prior Publication Data

US 2015/0101116 A1 Apr. 16, 2015

Related U.S. Application Data

(60) Provisional application No. 61/890,268, filed on Oct. 13, 2013.

(51) Int. Cl.

| | |
|---|---|
| ***E04H 4/06*** | (2006.01) |
| ***E04H 4/16*** | (2006.01) |
| ***E04H 4/08*** | (2006.01) |
| ***E04H 4/10*** | (2006.01) |

(52) U.S. Cl.

CPC ..... *E04H 4/16* (2013.01); *E04H 4/06* (2013.01); *E04H 4/082* (2013.01); *E04H 4/101* (2013.01)

(58) Field of Classification Search

CPC E04H 4/101; E04H 4/08; E04H 4/082; E04H 4/084; E04H 4/086; E04H 4/088; E04H 4/10

See application file for complete search history.

(56) References Cited

U.S. PATENT DOCUMENTS

| | | | | |
|---|---|---|---|---|
| 3,885,255 | A * | 5/1975 | Vorbach | E04H 4/101 4/502 |
| 3,982,286 | A * | 9/1976 | Foster | E04H 4/101 4/502 |
| 4,379,351 | A * | 4/1983 | Hinsperger | E04H 4/16 4/498 |
| 2013/0145538 | A1 * | 6/2013 | Seccareccia | F24J 2/0472 4/493 |

FOREIGN PATENT DOCUMENTS

| | | |
|---|---|---|
| DE | 7607660 | 7/1976 |
| DE | 4126796 | 2/1993 |

* cited by examiner

*Primary Examiner* — Janie Loeppke
(74) *Attorney, Agent, or Firm* — Reches Patents

(57) ABSTRACT

A pool cover system that may include a pool cover; a debris collection unit that is coupled to a front end of the pool cover; and a debris manipulator that is coupled to the debris collection unit and is arranged to move the debris collection unit between a debris collection position and a debris dumping position.

19 Claims, 6 Drawing Sheets

VIEW-A

POOL COVER LEADING EDGE RAKE

RELATED APPLICATIONS

This application claims the benefit of U.S. provisional patent Ser. No. 61/890,268 filing date Oct. 13, 2013 which is incorporated herein by reference in its entirety.

BACKGROUND

It is common practice nowadays to have swimming pools covered to prevent debris from entering the pool. Pool covers provide convenience for a user by allowing the cover to be easily extended over the pool during periods of non-use, and retracted during periods of use. In many cases swimming pools are located in gardens and near trees. This requires the pool owner or an attendant to manually skim floating debris out from the pool. These pool covers, when reeled-out or extracted to cover the pool water surface provide an excellent preventative measure against penetration of debris, such as twigs, leaves, dirt and the like into the pool with the ensuing accumulation and rotting or degradation of said debris inside the swimming pool.

Such pool covers are also used to preserve chemical materials which were added into the water in order to treat the water, in persevering preset, user convenient temperatures of pool water in the cases where electrical or solar water heaters or coolers are being used, prevention of water evaporation especially in areas where the scarcity or costs of water are prohibitive. Another paramount feature is the safety aspect, more particularly the drowning prevention which is attributed to a pool safety cover.

There are a variety of types of pool covers available on the market. Pool covers can be held above the pool water surface, for example: large low lying overhang constructions which from a removable roof over the pool or tarpaulin type/continuous sheets of flexible reinforced cover materials or made up of a construction of sturdy rigid materials which can be either manually or automatically spread/rolled or reeled out or rolled or reeled-in from the top of the pool to respectively, cover or uncover the entire swimming pool.

Pool covers can also be of a buoyant type which float on the water surface. The floatability or buoyancy are achieved by either means of the multitude of very sturdy and durable sealed rigid and hollow slats which are connected one to the other to form a flat surface or a continuous sheet of flexible reinforced material which is firmly attached to a roller which can be turned by a crank or wheel to roll or unroll the cover.

The covering and uncovering (or roll-out or roll-in) can be performed by firmly attaching an edge of the roller to a roller or drum. The roller/drum can be either turned by a crank or wheel to roll or unroll the pool cover (especially for the softer, lighter and flexible type pool covers) or be operated by means energy driven motors governed by electronic control systems (usually the hard, rigid and heavier pool cover types).

Each of said rigid slats or flexible cover materials form a singular independent float and when the sheet or all the slats are connected together the entire cover becomes one interlocked floating raft or one large floating blanket type cover. As discussed above, the cover is normally rolled and secured into a coil on a shaft or a drum which is extended between any of the sides or walls of the swimming pool.

The cover is deployed by activation or the turning of the crank of the said shaft by energy input, such as but not only an electrical motor, which is capable of turning the shaft in a clockwise or an anti clockwise direction in relation to its rotational axis planes to the pool surface. The movements would be in either the direction to or from the opposing pool side or pool wall and thereby causing the pool cover to move and floatingly slide or roll-out the pool cover all the way to the opposing wall. Thereby, the entire surface of the pool becomes covered. The roll-in operation or the opening of the said pool cover, and the exposing of the water surface, is performed in the opposite fashion. Such cover systems are suited to cover practically any shape of pool: rectangular, round, kidney shape or free style.

In all cases some type of securing the reeled-out cover into place are necessary. These may include anchor straps extending beyond the cover edges for attachment to the surrounding pool decking. Especially important is the front, or leading edge slat, which leads and guides the multitude of slats of the cover as it traverses the pool and would be the first slat to meet the opposite wall.

The said leading edge slat extends the width of the pool and is attached to the leading edge of the cover. A strap or another locking/attaching/securing mechanism would therefore be attached to said leading slat/edge for the purpose of securing the pool cover. Care should be taken to construct and assemble said leading slat in such a way that in the event of a reel-out that upon contacting the water surface said slat does not bow downward during extraction and turns over itself. The built of the leading edge is such that it will include a float and the edge of the slat will be inclined to a forward movement upon making contact with the water surface.

As mentioned above, a main purpose and objective of a pool cover is to offer preventative measures against the penetration of debris into the pool water thereby causing the debris to rot inside or at the bottom of the pool. Moreover, whilst the pool is being used by the swimmers, the cover is in a retracted position i.e.: it is reeled-in and rolled upon the main shaft or drum. During such time the pool is unprotected against the elements and debris and leaves continuously penetrate the pool water and annoyingly float upon the water surface.

Furthermore, when the pool cover is being extracted or reeled-out to close the pool, then the movement of the cover towards the opposite wall pushes, collects and concentrates all the floating debris and dirt forward. This phenomenon can bring about problematic accumulation of dirt and debris at the meeting area between the advancing cover and the opposite incoming wall which can cause tremendous difficulties in fully closing or locking the cover against the opposite wall. Worse, debris and dirt can sometimes penetrate underneath a cover and remain entrapped between the cover and the water to eventually rot, disintegrate and sink to the swimming pool bottom floor.

The only known preventions of this phenomenon would be for the pool owner or an attendant to either manually use a leaf rake which is attached to a rigid or telescopic pole or to use a leaf skimmer or by means of literally getting on his or her hands and knees and attempt to manually clean and clear out the accumulated debris and dirt so that the cover can fully close.

SUMMARY

According to an embodiment of the invention there may be provided a pool system that may include a pool cover; a debris collection unit that is coupled to a front end of the pool cover; and a debris manipulator that is coupled to the debris collection unit and is arranged to move the debris collection unit between a debris collection position and a debris dumping position.

The pool cover system wherein when positioned in the debris dumping position the debris collection unit may be arranged to dump, on the pool cover, at least a part of debris collected by the debris collection unit.

The debris collection unit may be arranged to move the debris collection unit by rotating the debris collection unit so that at least a portion of the debris collection unit is directly above a front area of the pool cover.

When the debris collection unit is positioned in the debris collection position at least a majority of the debris collection unit may be submerged and wherein when the debris collection unit is positioned in the debris dumping position most of the debris collection unit is positioned above the front end of the pool cover.

The debris collection unit may include an apertured front portion, an apertured rear portion and an apertured intermediate portion that is located between the front and rear apertured portions; wherein when the debris collection unit is positioned in the debris collection position an upper end of the apertured rear portion is higher than an upper end of the apertured front portion.

The debris collection unit may have a concave J-shaped cross section.

The debris collection unit may include a debris collection portion; wherein when the debris collection unit is positioned in the debris collection position at least a majority of the debris collection portion is positioned in front of the pool cover and wherein when the debris collection unit is positioned in the debris dumping position at least most of the debris collection unit is positioned after the front end of the pool cover.

The pool cover system further may include a sensor that is coupled to debris manipulator, wherein the debris manipulator is responsive to spatial information provided by the spatial sensor.

The sensor may be a mechanical sensor that may be arranged to trigger a movement of the debris collection unit from the debris collection position to debris dumping position upon contact with a pool sidewall that faces the front end of the pool cover.

The sensor is may be an electromagnetic sensor that may be arranged to trigger a movement of the debris collection unit from the debris collection position to debris dumping position when sensing that a pool sidewall that faces the front end of the pool cover is within a predefined distance from the front end of the pool cover.

The debris manipulator may include a contact element and a transmission system wherein the contact element may be arranged to change a position upon contact with a pool sidewall that faces the front end of the pool cover and wherein the transmission system may be arranged to convert the change of position of the contact element to a change in a position of the debris cleaning unit.

The debris manipulator may include a rod that has jagged surface; a gear and a gear axis; wherein the gear axis is connected to a debris collection unit; wherein the jagged surface of the rod meshes with the gear thereby translating a backward movement of the rod to a rotation of the debris collection unit about the gear axis.

The rod may be connected to a spring that induced the rod to move forward.

The pool cover system may include at least one solar panel that is coupled to the pool cover.

The pool cover system may include at least one solar panel for providing electrical energy, a battery for receiving the electrical energy, wherein the battery is electrically coupled to at least one element out of a sensor and a pool cover manipulator.

The at least one solar panel may be multiple solar panels; wherein the pool cover may include multiple slates that are hinged to each other; and wherein a plurality of slates are coupled to a plurality of solar panels.

The pool cover system wherein each solar panel of the at least one solar panels is made of suitable and compatible glass or other material.

The pool cover may include multiple floating slates that are hinged to each other.

The pool cover system further may include a winding mechanism that is connected to a rear portion of the pool cover and may be arranged to wind the pool cover during a pool uncover process and to unwind the pool cover during a pool cover process.

According to an embodiment of the invention there may be provided a pool cover system that may include a pool cover and at least one solar panel.

The at least one solar panel may provide electrical energy, a battery for receiving the electrical energy, wherein the battery is electrically coupled to at least one element out of a sensor and a pool cover manipulator.

The at least one solar panel may be multiple solar panels; wherein the pool cover may include multiple slates that are hinged to each other; and wherein a plurality of slates are coupled to a plurality of solar panels.

Each solar panel of the at least one solar panels may be is made of suitable and compatible glass or other material.

According to an embodiment of the invention there may be provided a kit that may include a debris collection unit having a pool cover interface for interfacing the debris collection unit to a pool cover; and a debris manipulator that is coupled to the debris collection unit and may be arranged to move the debris collection unit between a debris collection position and a debris dumping position.

BRIEF DESCRIPTION OF THE DRAWINGS

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF THE DRAWINGS

Figure 1:
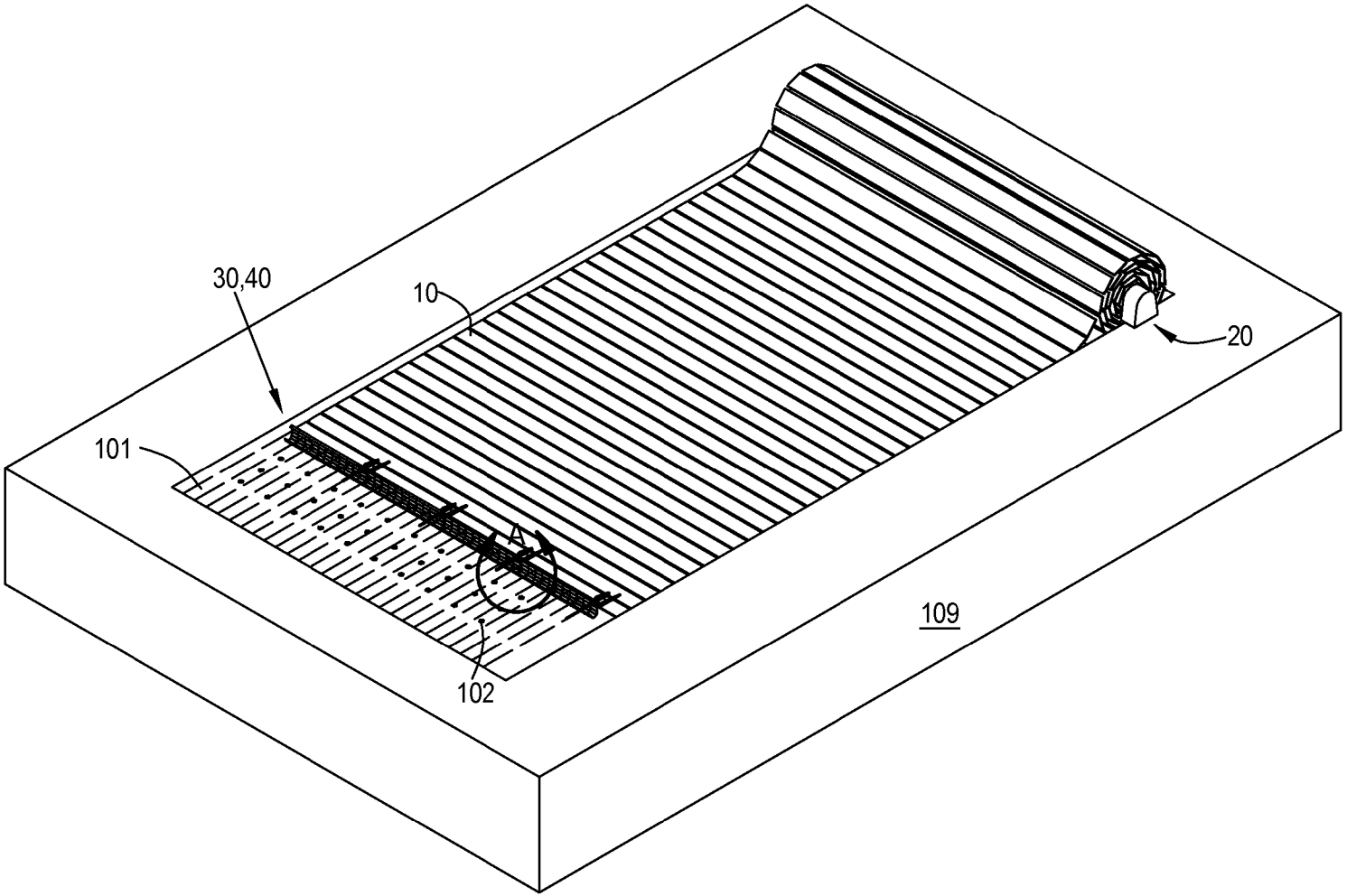
FIG. 1 illustrate a pool and a pool cover system according to an embodiment of the invention.
Figure 2:
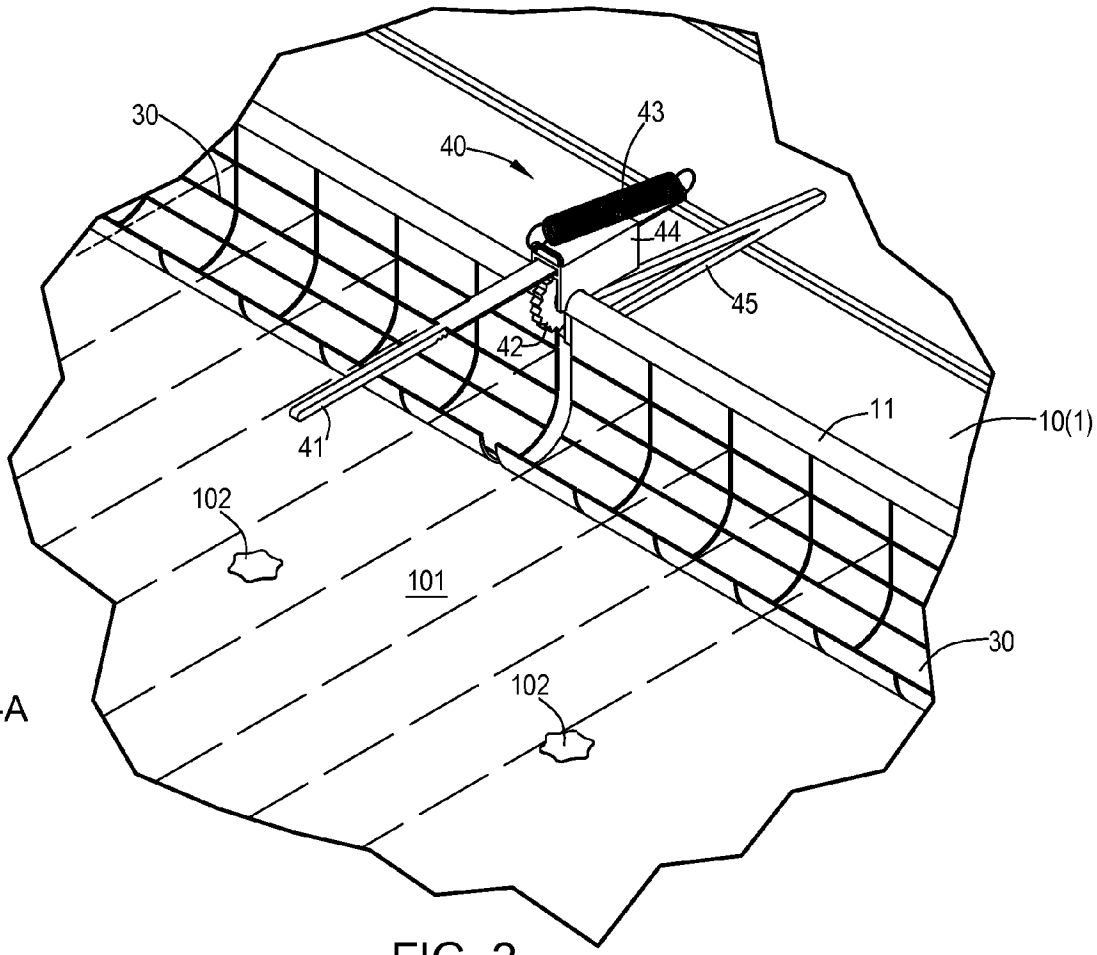
FIG. 2 illustrates a portion of a pool cover system according to an embodiment of the invention.

In the following detailed description, numerous specific details are set forth in order to provide a thorough understanding of the invention. However, it will be understood by those skilled in the art that the present invention may be practiced without these specific details. In other instances, well-known methods, procedures, and components have not been described in detail so as not to obscure the present invention.

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

Any reference in the specification to a system should be applied mutatis mutandis to a method that can be executed by the system.

Because the illustrated embodiments of the present invention may for the most part, be implemented using electronic components and circuits known to those skilled in the art, details will not be explained in any greater extent than that considered necessary as illustrated above, for the understanding and appreciation of the underlying concepts of the present invention and in order not to obfuscate or distract from the teachings of the present invention.

Any reference in the specification to a method should be applied mutatis mutandis to a system capable of executing the method.

According to an embodiment of the invention there is provided a pool cover system that may be buoyant-self-supporting, automatically or manually powered or propelled or moveable. It contains a debris collection mechanism that is self-activated and automatically emptyable or drainable.

The terms "debris collection unit", rake and receptacle are used in an interchangeable manner.

The term "debris" refers to any particle that can be collected by the debris collection unit. It may include, for example, twigs and/or leafs.

The pool cover system includes a debris collection unit that may extend to the entire width/length of the pool water surface.

The pool cover system may be powered by conventional electric motor, by a hydraulic motor (water motor) and the like or manually by, for example. hand crank.

In case of the electric motor the pool cover system may include solar panels. The solar panels may be attached to the pool cover or be embedded inside the pool cover floating slats.

The solar panels can cover the entire pool cover or only a part of the entire pool cover. For example, if the pool cover includes multiple slats that are hinged to each other than some or all of these slats may be connected to the solar panels.

The solar panels may be of any known type. For example they may be glass-covered panels. The glass covered solar panels may be scratch, high impact and high load strain resistant. The solar panels may be designed to withstand humans stepping onto the pool cover, jumping or falling onto it etc. and be electrically insulating. They may alternatively be made of a lighter, clear material that is designed to have the above characteristics and in addition also be resistant to stress cracking due to the continuous long term exposure to UV radiation and water chemicals such as chlorine, bromine, acids etc.

Non-limiting examples of ruggedized solar panels are the solar panels that are developed by Solar Roadways of Idaho USA in an initiative to build roads made of solar panels. Yet other examples of ruggedized solar panels include the Aurinco solar panels and the Solara walk-on solar panels of OceanPlanet Inc. of Maine USA.

The power generated by the solar panels may feed one or more battery that in turn may feed at least one out of (a) a winding mechanism that is arranged to wind the pool cover during a pool uncover process and to unwind the pool cover during a pool cover process, (b) one or more sensors, (c) one or more controllers, (d) one or more motors or activators for manipulating a debris collection unit, and/or (e) heating elements for heating the water of the pool. (f) any other electrical device.

The one or more batteries may be included in the winding mechanism, in proximity to the debris collection unit and/or in proximity to a debris manipulator.

It is noted that the pool cover may be of any type. It may include a single sheet, may include multiple slats, it can be made of a floatable material, may include parts made of floatable material, may include air filled spaced, may be rigid, may be flexible, and the like.

FIGS. 1, 2, 3A-3F and 4A-4C illustrate a pool cover system and portions of the pool cover system according to various embodiments of the invention.

A pool cover system may include the pool cover, a debris collection unit and a debris manipulator. The pool cover system may also include at least one out of a (a) a winding mechanism, (b) one or more solar panels, (c) one or more batteries, (d) one or more conductive elements for supplying power, (e) one or more sensors, (f) one or more controllers, and (g) heating elements for heating the water of the pool, (h) motors FIG. 1 illustrates a pool cover 10 that has its front edge 11 or leading edge or front slat that may include (or may be connected) to an attachable receptacle (also referred to as debris collection unit) 30 that may be in the form of a J-shaped channel or duct (see FIG. 2), which is apertured and/or made of from a porous material. FIG. 1 also illustrates the surface 101 of the water and debris 102. FIG. 1 shows and FIGS. 2 and 3A-3F illustrate a debris manipulator 40.

This receptacle 30 can act as a rake whilst the pool cover is advancing in a reeling-out or pool covering mode.

Referring to FIGS. 3A-3F, when in its forward movement, the receptacle 30 will rake debris which is floating on or near the water surface up to the point when a rod 41 of a debris manipulator 40 impacts the incoming opposing wall. The rod 41 may have a soft end or may be made of a soft material in order to prevent or reduce any possible damage that may occur from the contact with the sidewall.

The debris manipulator 40 may include a rake triggering device such as rod 41 which is moveably seated inside a bracket 44 which is connected to the front slat or edge of the pool cover by means of an axle 49. The rod 41 is also connected to a spring 43 which has the purpose of returning the receptacle 30 to its original position when the pool cover is being reeled-in. Axle 49 may be pivotally coupled to supporting element 45. Spring 43 can be released after the pool cover process ends. Spring 43 can be replaced by another rod constraint mechanism that will control the backward progress of the rod 41 such as a compression spring mechanism.

When the pool cover 10 is being reeled-out and upon impacting the incoming pool wall 110 the rod 41 pushes the receptacle 30 to perform an upward circular pivoting movement (for example by 180 degrees) which in turn reverses the said receptacle 30 backwards, to empty the accumulated debris inside the receptacle 30, onto the surface of the pool cover 10.

This ensures that all debris raked during the reeling-out process have been evacuated and are now stored out of water on the top of the pool cover 10 and ready for collection by the end user.

Rod 41 may have a lower jagged surface 41(1) that meshes with gear 42 that is connected, at its center to axel 49. The linear movement of the rod 41 causes the gear 42 and the axel to rotate hereby rotating receptacle 30.

Figure 3A:
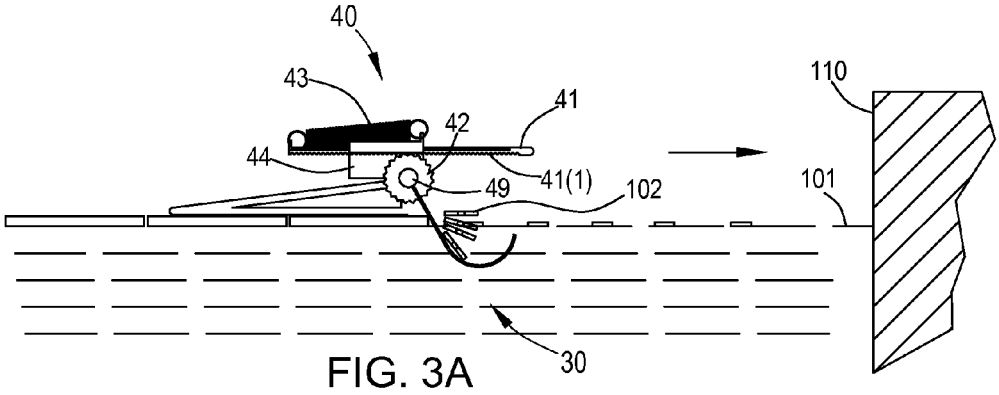
FIGS. 3A-3F are cross sectional views that illustrate a portion of a pool cover system at different points of time according to various embodiments of the invention.
Figure 3B:
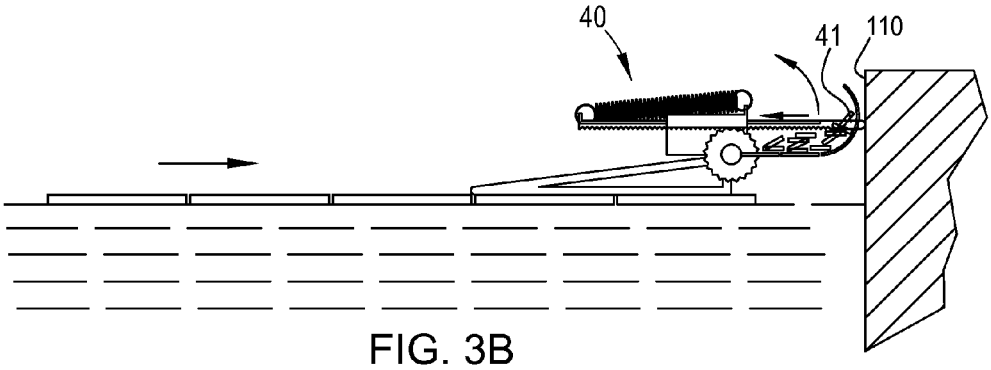
Figure 3C:
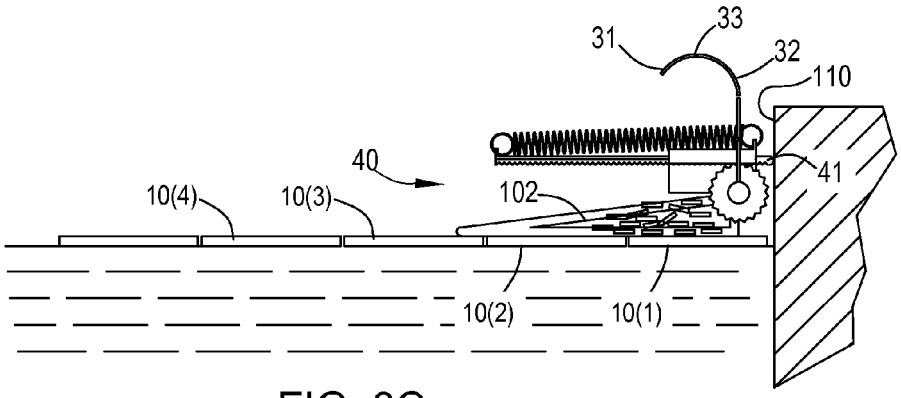
Figure 3D:
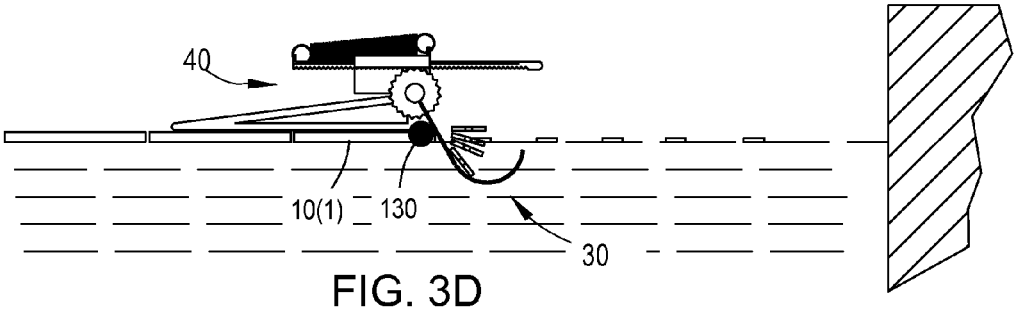

FIGS. 3A and 3D illustrate a pool cover 10, receptacle 30 and debris manipulator 40 as moving forwards during a pool cover process. In this figure the receptacle is in a debris collection position in which it is submerged and collects debris.

Figure 3E:
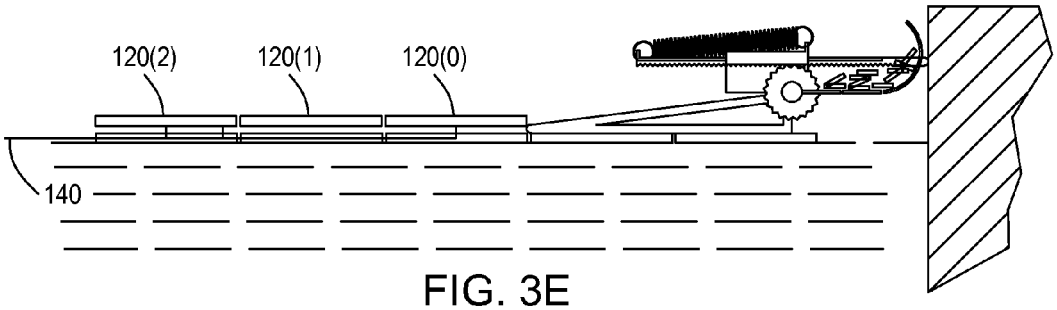

FIGS. 3B and 3E illustrate the first contact between the rod 41 and a sidewall 110 of the pool. In this point the pool cover still continues to move forward and the receptacle is still in a debris collection position.

Figure 3F:
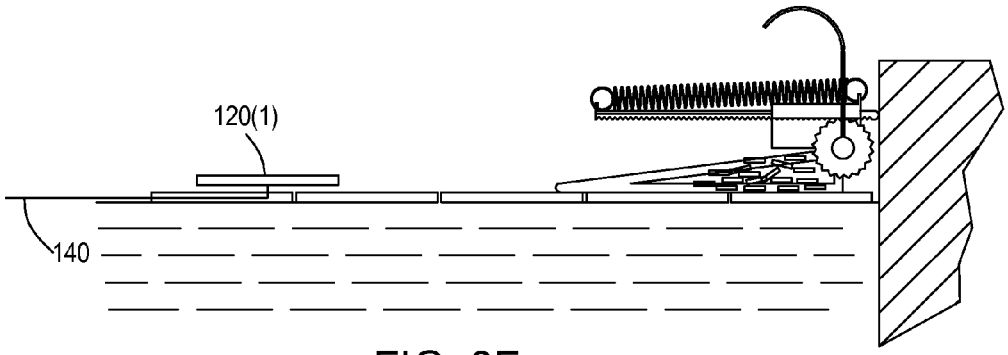

FIGS. 3C and 3F illustrate the rod 41 as being in a backward position (after moving backward in relation to the pool cover) while still contacting the sidewall 110 of the pool. At this point the pool cover may stop moving forward (or may further move forward in order to seal the pool) but the receptacle is in a debris dumping position in which it is upside down and above the pool cover 10 whereas debris 102 previously collected by the receptacle 30 falls onto the pool cover 10. FIG. 3C also illustrates that the debris collection unit 30 has a front portion 31, an intermediate portion 33 and a rear portion 32. When in the debris collection position the upper end of the front portion 31 may be lower than the upper end of the rear portion 32. The debris collection unit 30 can be made of a mesh, may include apertures and/or made of porous material of a variety of pore sizes. The debris collection unit may be supplied in a replaceable kit form that enables fitting a variety of pore size material depending on needs, FIG. 3D further shows a buoy or float 130 connected to a front rear edge 11 of a first slat 10(1) of the pool cover 10.

FIG. 3E further shows a conductor 140 and solar panels 120(0)-120(2) connected to slats of the pool cover 10—a solar panel per slat.

FIG. 3F further shows a conductor 140 and a solar panel 120(1) connected to a slat of the pool cover 10—while other slats are not connected to solar panels or the solar panel is embedded onto the pool cover slat.

Figure 4A:
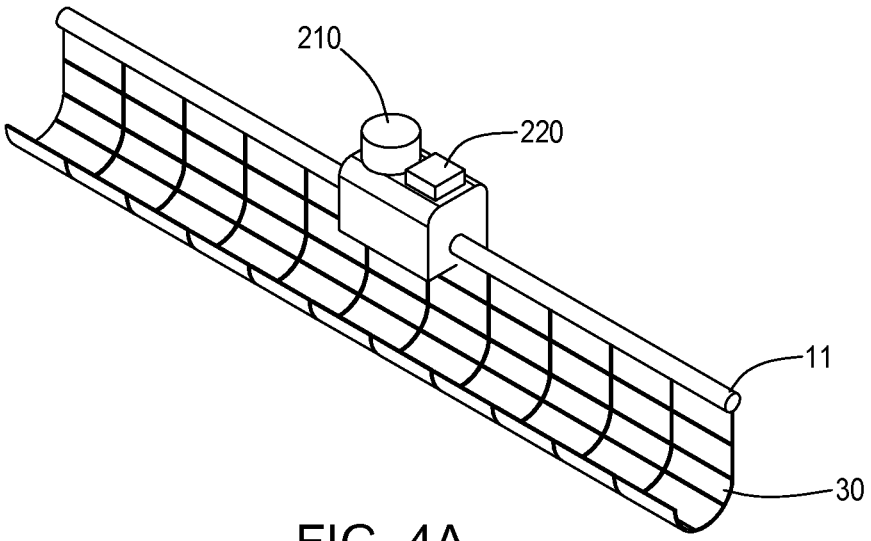
FIGS. 4A-4C illustrate portions of pool cover systems according to various embodiments of the invention.

FIG. 4A illustrates a receptacle 30 and a debris manipulator that includes a motor 210 and a sensor 220 according to an embodiment of the invention.

The motor 210 can move the receptacle 30 from a debris collection position to a debris dumping position in response to detection signals from sensor 220 that may represent the distance between the sensor and a pool sidewall and/or may represent an absolute location of the sensor 220. If the sensor is about to reach the sidewall (is within a certain distance such as few centimeters, 10-20 centimeters and the like) the motor can perform the movement.

In any of the embodiments illustrated above the change of position should occur at a distance that will enable the change of position of the receptacle. If the change of position is implemented by rotation then the distance between the front edge of the pool cover and the pool sidewall should exceed the height (or depth) of the receptacle.

It is noted that even after positioning the receptacle 30 at the debris dumping position the pool cover may still progress forwards in order to cover the pool.

It is further noted that the change of position of the receptacle can occur multiple times during the pool coverage process. In this case the receptacle is moved between the debris collection position to the debris dumping position and then to the debris collection position.

These changes of position may be provided in order to ease the change of position and prevent too much debris from accumulating on the receptacle. One or more of these changes of position can be triggered by a lapse of time and/or distance from the start of the pool cover unwinding or winding process or from the previous dumping of debris.

Different changes of position may be evenly or unevenly spaced from each other. Additionally or alternatively, a changing of position may be triggered in response to a measurement of the amount and/or weight of the accumulated debris in the debris collection unit/receptacle and/or countering pressure resistance created in and during the path of the pool cover movement. The weight may be sensed by a weight sensor that may be connected to the receptacle, by an image sensor that aims to image the receptacle and find debris.

Figure 4B:
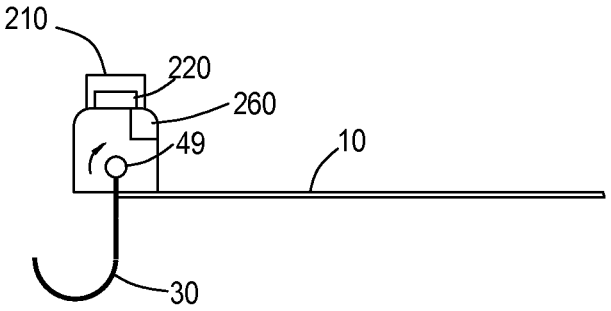

The changes of position may be controlled by a controller (such as controller 260 of FIG. 4B), that may be responsive to timing information (can be generated by the controller or by an external timer connected to the controller), or by a sensor. FIG. 4B illustrates a proximity or location sensor 220.

Figure 4C:
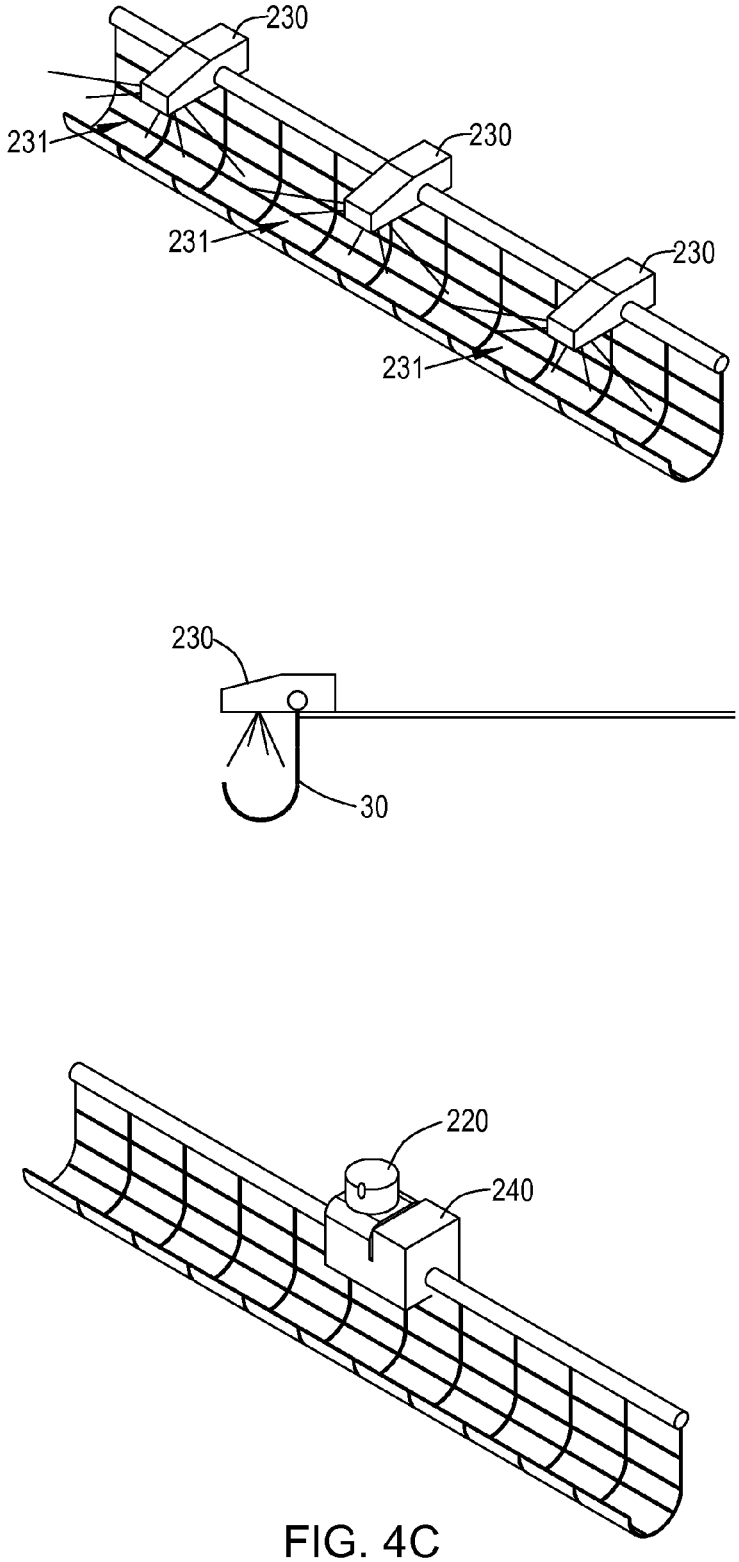

FIG. 4C illustrates a group of imaging sensors 230 having fields of view 231 that in combination "cover" the receptacle.

FIG. 4C also shows two types of sensors 220 and 240. Sensor 220 may be a proximity and/or location sensor or any other sensor for triggering the change of position at the end of the pool coverage process. Sensor 240 may be a weight sensor or an imaging sensor it may trigger changes of position of the receptacle before reaching the vicinity of the pool sidewall. All sensors in each of these figures may be coupled to a controller.

FIG. 4C also illustrates a non-J or concave cross section receptacle 30 and an ultrasonic sensor 230.

It is noted that the movement of the pool cover can be executed regardless of the position (and/or change of position) of the receptacle. Alternatively, the progress may be responsive to the changing of position. For example the pool cover progress may be slowed and even stopped when the receptacle moves from the debris collection position to the debris dumping position and until it returns to the debris collection position. It is noted that when approaching the sidewall of the pool the receptacle may be allowed to remain in its debris dumping position until the pool cover starts a pool uncovering process.

It is noted that the pool cover 10 may include multiple debris collection units. The different debris collection units may be operated independently to each other and/or in relation to in each other. The different debris collection units may be similar to each other, different from each other, be similar to debris collection unit 30 illustrated in the figures or may differ from it. One or more debris collection units may include sensors while other may not include sensors. Different debris collection units may be triggered by the same trigger or by different triggers. For example, the debris collection units may be located side by side such as to span along the entire width of the pool that is being covered by the pool cover. The different debris collection units may be fixed and/or may be moved in relation to each other. For example and referring to FIG. 2—the two parts of debris collection unit 30 located at both sides of debris manipulator 40 can be operated independently (and this may require an additional debris manipulator 40—one debris manipulator 40 per each portion).

In the foregoing specification, the invention has been described with reference to specific examples of embodiments of the invention. It will, however, be evident that various modifications and changes may be made therein without departing from the broader spirit and scope of the invention as set forth in the appended claims.

Moreover, the terms "front," "back," "top," "bottom," "over," "under" and the like in the description and in the claims, if any, are used for descriptive purposes and not necessarily for describing permanent relative positions. It is understood that the terms so used are interchangeable under appropriate circumstances such that the embodiments of the invention described herein are, for example, capable of operation in other orientations than those illustrated or otherwise described herein.

Those skilled in the art will recognize that the boundaries between logic blocks are merely illustrative and that alternative embodiments may merge logic blocks or circuit elements or impose an alternate decomposition of functionality upon various logic blocks or circuit elements. Thus, it is to be understood that the architectures depicted herein are merely exemplary, and that in fact many other architectures can be implemented which achieve the same functionality.

Any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality.

Furthermore, those skilled in the art will recognize that boundaries between the above described operations merely illustrative. The multiple operations may be combined into a single operation, a single operation may be distributed in additional operations and operations may be executed at least partially overlapping in time. Moreover, alternative embodiments may include multiple instances of a particular operation, and the order of operations may be altered in various other embodiments.

Also for example, in one embodiment, the illustrated examples may be implemented as circuitry located on a single integrated circuit or within a same device. Alternatively, the examples may be implemented as any number of separate integrated circuits or separate devices interconnected with each other in a suitable manner.

Also for example, the examples, or portions thereof, may implemented as soft or code representations of physical circuitry or of logical representations convertible into physical circuitry, such as in a hardware description language of any appropriate type.

Also, the invention is not limited to physical devices or units implemented in non-programmable hardware but can also be applied in programmable devices or units able to perform the desired device functions by operating in accordance with suitable program code, such as mainframes, minicomputers, servers, workstations, personal computers, notepads, personal digital assistants, electronic games, automotive and other embedded systems, cell phones and various other wireless devices, commonly denoted in this application as 'computer systems'.

However, other modifications, variations and alternatives are also possible. The specifications and drawings are, accordingly, to be regarded in an illustrative rather than in a restrictive sense.

In the claims, any reference signs placed between parentheses shall not be construed as limiting the claim. The word 'comprising' does not exclude the presence of other elements or steps then those listed in a claim. Furthermore, the terms "a" or "an," as used herein, are defined as one or more than one. Also, the use of introductory phrases such as "at least one" and "one or more" in the claims should not be construed to imply that the introduction of another claim element by the indefinite articles "a" or "an" limits any particular claim containing such introduced claim element to inventions containing only one such element, even when the same claim includes the introductory phrases "one or more" or "at least one" and indefinite articles such as "a" or "an." The same holds true for the use of definite articles. Unless stated otherwise, terms such as "first" and "second" are used to arbitrarily distinguish between the elements such terms describe. Thus, these terms are not necessarily intended to indicate temporal or other prioritization of such elements the mere fact that certain measures are recited in mutually different claims does not indicate that a combination of these measures cannot be used to advantage.

Any system, apparatus or device referred to this patent application includes at least one hardware component.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

We claim:

1. A pool cover system, comprising:

a pool cover;

a debris collection unit that is coupled to a front end of the pool cover; and a debris manipulator that is coupled to the debris collection unit and is arranged to move the debris collection unit between a debris collection position and a debris dumping position;

wherein the debris manipulator comprises a rod that has a jagged surface, a gear and a gear axis;

wherein the gear axis is connected to the debris collection unit;

wherein the jagged surface of the rod meshes with the gear thereby translating a backward movement of the rod to a rotation of the debris collection unit about the gear axis.

2. The pool cover system according to claim 1 wherein when positioned in the debris dumping position the debris collection unit is arranged to dump, on the pool cover, at least a part of the debris.

3. The pool cover system according to claim 1 wherein the rotation of the debris collection unit about the gear axis results in having at least a portion of the debris collection unit directly above a front area of the pool cover.

4. The pool cover system according to claim 1 wherein when the debris collection unit is positioned in the debris collection position at least a majority of the debris collection unit is submerged and wherein when the debris collection unit is positioned in the debris dumping position at least fifty percent of the debris collection unit is positioned above the front end of the pool cover.

5. The pool cover system according to claim 1 wherein the debris collection unit comprises an apertured front portion, an apertured rear portion and an apertured intermediate portion that is located between the front and rear apertured portions; wherein when the debris collection unit is positioned in the debris collection position an upper end of the apertured rear portion is higher than an upper end of the apertured front portion.

6. The pool covers system according to claim 1 wherein the debris collection unit has a concave J-shaped cross section.

7. The pool cover system according to claim 1 wherein the debris collection unit comprises a debris collection portion; wherein when the debris collection unit is positioned in the debris collection position at least a majority of the debris collection portion is positioned in front of the pool cover and wherein when the debris collection unit is positioned in the debris dumping position at least fifty percent of the debris collection unit is positioned after the front end of the pool cover.

8. The pool cover system according to claim 1 further comprising a sensor that is coupled to the debris manipulator, wherein the debris manipulator is responsive to information provided by the sensor.

9. The pool cover system according to claim 8 wherein the sensor is a mechanical sensor that is arranged to trigger the rotation of the debris collection unit about the gear axis.

10. The pool cover system according to claim 8 wherein the sensor is an electromagnetic sensor that is arranged to trigger a movement of the debris collection unit from the debris collection position to debris dumping position when sensing that a pool sidewall that faces the front end of the pool cover is within a predefined distance from the front end of the pool cover.

11. The pool cover system according to claim 1 wherein the rod is connected to a spring that induced the rod to move forward.

12. The pool cover system according to claim 1 further comprising at least one solar panel that is coupled to the pool cover.

13. The pool cover system according to claim 1 further comprising at least one solar panel for providing electrical energy, a battery for receiving the electrical energy, wherein the battery is electrically coupled to at least one element out of a sensor and a pool cover manipulator.

14. The pool cover system according to claim 12 wherein the at least one solar panel is multiple solar panels; wherein the pool cover comprises multiple slates that are hinged to each other; and wherein a plurality of slates are coupled to a plurality of solar panels.

15. The pool cover system according to claim 1 wherein the pool cover comprises multiple floating slates that are hinged to each other.

16. The pool cover system according to claim 1 further comprising a winding mechanism that is connected to a rear portion of the pool cover and is arranged to wind the pool cover during a pool uncover process and to unwind the pool cover during a pool cover process.

17. A kit comprising a debris collection unit having a pool cover interface for interfacing the debris collection unit to a pool cover; and a debris manipulator that is coupled to the debris collection unit and is arranged to move the debris collection unit between a debris collection position and a debris dumping position; wherein the debris manipulator comprises a rod that has a jagged surface, a gear and a gear axis; wherein the gear axis is connected to the debris collection unit; and wherein the jagged surface of the rod meshes with the gear thereby translating a backward movement of the rod to a rotation of the debris collection unit about the gear axis.

18. The pool cover system according to claim 12 wherein the at least one solar panel is capable of withstanding humans stepping onto the pool cover.

19. The pool cover system according to claim 12 wherein the at least one solar panel is a walk on solar panel.

* * * * *